US009033023B2

(12) United States Patent
Ijichi et al.

(10) Patent No.: US 9,033,023 B2
(45) Date of Patent: May 19, 2015

(54) COPPER ALLOY AND COPPER ALLOY MANUFACTURING METHOD

(75) Inventors: Yoshihito Ijichi, Moriya (JP); Kenichi Ohshima, Tsukuba (JP)

(73) Assignees: SHIROGANE CO., LTD., Tochigi-Ken (JP); UNIVERSITY OF TSUKUBA, Ibaraki-Ken (JP)

( * ) Notice: Subject to any disclaimer, the term of this patent is extended or adjusted under 35 U.S.C. 154(b) by 584 days.

(21) Appl. No.: 13/393,253

(22) PCT Filed: Sep. 3, 2010

(86) PCT No.: PCT/JP2010/065131

§ 371 (c)(1),
(2), (4) Date: May 14, 2012

(87) PCT Pub. No.: WO2011/027858

PCT Pub. Date: Mar. 10, 2011

(65) Prior Publication Data

US 2012/0219452 A1 Aug. 30, 2012

(30) Foreign Application Priority Data

Sep. 7, 2009 (JP) ..... 2009-206247

(51) Int. Cl.

| | |
|---|---|
| ***B22D 23/00*** | (2006.01) |
| ***H01B 1/02*** | (2006.01) |
| ***C22C 1/02*** | (2006.01) |
| ***C22C 1/10*** | (2006.01) |
| ***C22C 9/00*** | (2006.01) |

(52) U.S. Cl.

CPC *H01B 1/02* (2013.01); *B22D 23/00* (2013.01); *C22C 1/02* (2013.01); *C22C 1/1036* (2013.01); *C22C 9/00* (2013.01); *H01B 1/026* (2013.01)

(58) Field of Classification Search

CPC ..... B22D 23/00; B22D 27/04; H01B 1/02; H01B 1/026; C22C 1/02; C22C 1/1036; C22C 9/00

USPC ..... 164/55.1, 56.1; 75/638

See application file for complete search history.

(56) References Cited

U.S. PATENT DOCUMENTS

| | | | | |
|---|---|---|---|---|
| 3,305,902 | A * | 2/1967 | Bjorksten | 164/55.1 |
| 3,467,167 | A * | 9/1969 | Mahin | 164/473 |
| 4,518,418 | A * | 5/1985 | Fletcher et al. | 75/10.29 |

FOREIGN PATENT DOCUMENTS

| | | |
|---|---|---|
| CN | 1186870 | 7/1998 |
| CN | 101204761 | 6/2008 |
| JP | 62-267437 | 11/1987 |
| JP | 9-20942 | 1/1997 |
| WO | 2009/075314 | 6/2009 |

OTHER PUBLICATIONS

"Wrought copper-nickel, CW352H (CEN EN 12165(98)) (Forging stock, H070 condition, 6-80mm)", Worldwide Guide to Equivalent Nonferrous Alloys, 4th ed. ASM International 2001.*

International Search Report issued Nov. 30, 2010 in International (PCT) Application No. PCT/JP2010/065131, of which the present application is the national stage.

International Preliminary Report on Patentability and Written Opinion issued Apr. 11, 2012 in International Application No. PCT/JP2010/065131, of which the present application is the national stage.

Official Action issued Jun. 14, 2013 in corresponding Russian Application No. 2012113530/02(020510), with English translation.

Second Notification of Reason for Rejection issued Sep. 16, 2013 in Chinese Application No. 201080037901.8, with English translation.

* cited by examiner

*Primary Examiner* — Kevin P Kerns

(74) *Attorney, Agent, or Firm* — Wenderoth, Lind & Ponack, L.L.P.

(57) ABSTRACT

A copper alloy having an electrical resistivity lower than those of current copper alloys and a tensile strength higher than those of current copper alloys and a method of manufacturing such a copper alloy are provided. The copper alloy is produced by adding a predetermined amount of carbon to a molten copper in a high-temperature environment of a temperature in the range of 1200° C. to 1250° C. such that the copper alloy has a carbon content in the range of 0.01% to 0.6% by weight.

6 Claims, 2 Drawing Sheets

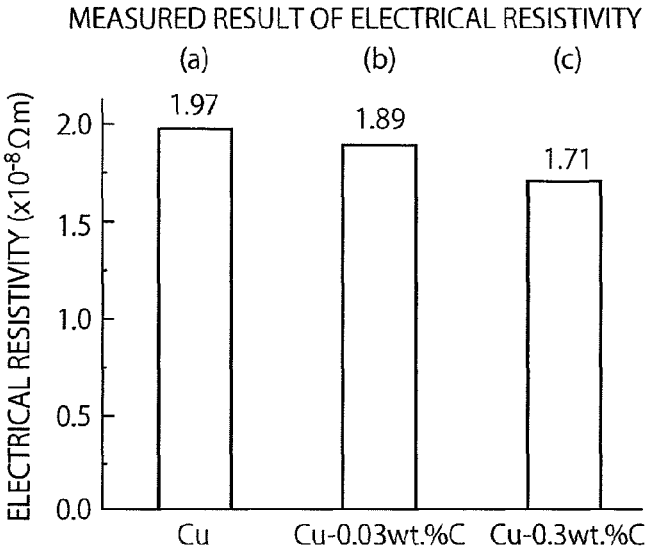
FIG. 3
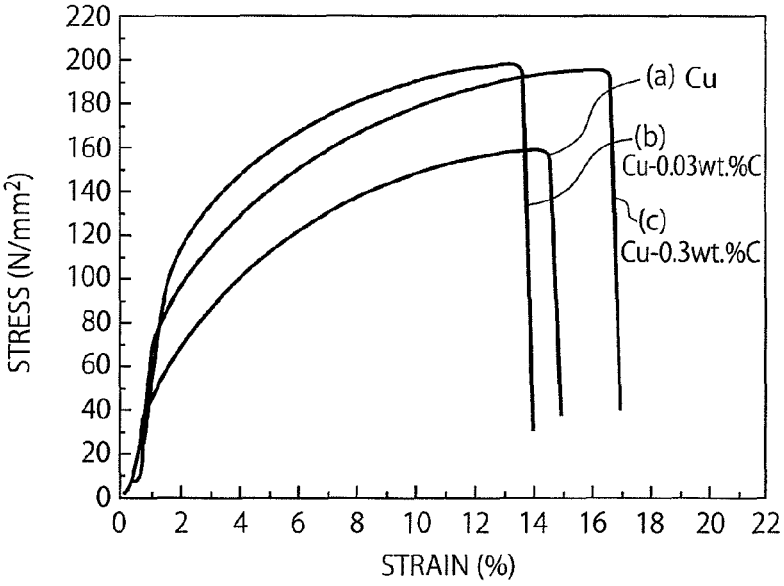
FIG. 4
| SPECIMENS | (a) : Cu | (b) : Cu-0.03wt.%C | (c) : Cu-0.3wt.%C |
|---|---|---|---|
| YIELD STRESS (N/mm$^2$) | 33 | 95 | 76 |
| TENSILE STRENGTH (MPa) | 159 | 195 | 189 |
FIG. 5

COPPER ALLOY AND COPPER ALLOY MANUFACTURING METHOD

TECHNICAL FIELD

The present invention relates to a copper alloy and, more specifically, to a carbon-bearing copper alloy produced by adding carbon to a copper material.

BACKGROUND ART

Copper materials are materials having high electric conductivity and high workability among general metals. Copper materials are used for making electric wires and copper alloys.

REFERENCE DOCUMENT

Patent Document

Patent document 1: JP 2007-92176 A

DISCLOSURE OF THE INVENTION

Problem to be Solved by the Invention

Power transmission lines, for example, are used for transferring electric power from one location to a distant location. Therefore, even a slight reduction of the electric resistance of power transmission lines has a great Joule heat reducing effect, and hence there is always a great demand for the development of copper materials having a lower electrical resistivity. Copper materials for forming electric wires need to have a high tensile strength and high workability as well as a low electrical resistivity.

Current copper materials, however, have a high electrical resistivity and a low tensile strength.

Nothing has been clearly shown about a carbon content (% by weight) that can be had by a carbon-bearing copper material, an effective carbon content and a method of adding carbon to a copper material.

Means for Solving the Problem

The present invention has been made on the basis of the inventor's knowledge of a method that can add carbon, specifically, graphite of the hexagonal system, to copper such that carbon is dispersed in copper in practically acceptable uniformity.

It is an object of the present invention to solve problems in the prior art and to provide a copper alloy having an electrical resistivity lower than those of current copper alloys and a tensile strength higher than those of current copper alloys and a method of manufacturing such a copper alloy.

The present invention provides a copper alloy obtained by adding carbon to molten copper melted in a high-temperature environment such that the copper material has a predetermined carbon content in the range of 0.01% to 0.6% by weight.

The temperature of the high-temperature environment may be in the range of 1200° C. to 1250° C.

The carbon may be graphite of the hexagonal system.

A carbon dispersant may be added together with carbon to the copper material.

Preferably, the predetermined carbon content is in the range of 0.03% to 0.3% by weight.

The present invention provides a copper alloy manufacturing method including: a melting process of melting a copper material and removing oxygen from the copper material by heating the copper material in a high-temperature metal-melting furnace at a high temperature; a carbon-adding process of adding a predetermined amount of carbon to the molten copper material melted by the melting process; a stirring process of stirring a mixture of the copper material and the carbon; and a pouring process of pouring the stirred mixture of the copper material and the carbon into a mold and cooling the mixture to solidify the mixture in the mold.

A carbon dispersant may be added together with the carbon to the copper material heated at the high temperature to promote mixing the carbon with the copper material heated at a high temperature in the carbon-adding process.

The high temperature may be in the range of 1200° C. to 1250° C.

The predetermined amount of the carbon may be determined such that the copper alloy has a carbon content in the range of 0.01% to 0.6% by weight.

Preferably, the predetermined amount of the carbon may be determined such that the copper alloy has a carbon content in the range of 0.03% to 0.3% by weight.

The high-temperature melting furnace may have a melting unit to be charged with the copper material and the carbon, a heating space forming unit forming a closed heating space over the melting unit, a heating unit for supplying a heating fuel into the closed heating space to heat the melting unit, and an exhaust opening opening into the heating space forming unit.

The rate of supplying the heating fuel into the closed heating space is regulated such that the amount of oxygen discharged through the exhaust opening decreases to zero.

BRIEF DESCRIPTION OF THE DRAWINGS

FIG. 3 is a graph showing measured electrical resistivities

FIG. 4 is a graph showing results of tensile tests; and

FIG. 5 is a table of measured yield stresses (MPa) and tensile strengths (MPa) shown in FIG. 4.

BEST MODE FOR CARRYING OUT THE INVENTION

Figure 1:
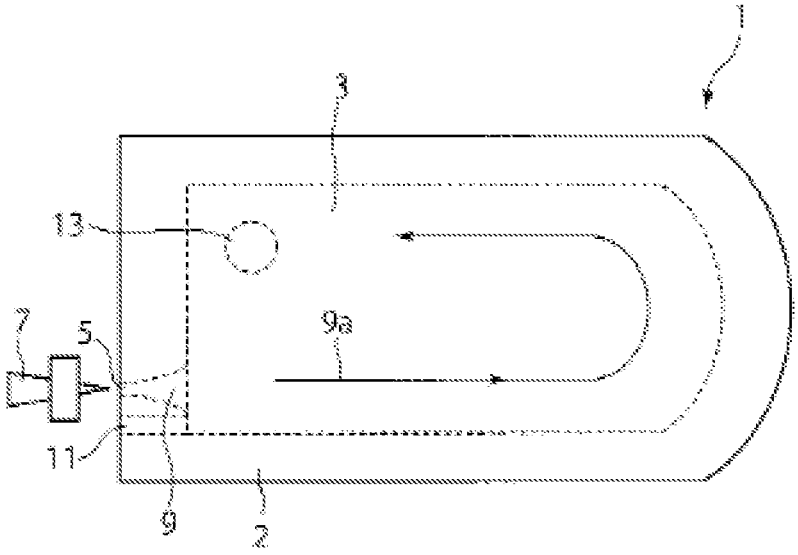
FIG. 1 is a plan view of a high-temperature metal melting furnace.

Preferred embodiments of the present invention will be described.

A copper alloy in a preferred embodiment of the present invention is obtained by adding a predetermined amount of carbon to molten copper in a high-temperature environment such that the copper alloy has a carbon content in the range of 0.01% to 0.6% by weight.

The high-temperature environment can enable the addition of carbon to molten copper such that carbon is dispersed in practically acceptable uniformity. The temperature of the high-temperature environment is in the range of 1200° C. to 1250° C. and higher than the melting point of copper of 1083° C.

If the temperature of the high-temperature environment is lower than 1200° C., copper cannot be satisfactorily melted and it is hard for added carbon to be dispersed uniformly in molten copper. The temperature of the high-temperature environment needs to be sufficiently higher than the melting point of copper, namely, 1083° C., to melt a copper material uniformly in the high-temperature metal melting furnace. If the temperature of the high-temperature environment is higher than 1250° C., carbon particles added to molten copper repel each other, tend to be localized and are hard to disperse uniformly, and the molten copper tends to boil. Thus, temperatures higher than 1250° C. are not suitable for manufacturing the copper alloy. It is practically necessary to avoid components of a structural material, which includes carbon and forms the high temperature metal furnace, being melted and separated from the structural material. Therefore, it is preferable that the temperature is not higher than 1250° C. Although carbon needs to be added to molten copper in the high-temperature environment of a higher temperature, ideal addition of carbon to molten copper can be achieved at a temperature not higher than 1250° C. If carbon is added to molten copper in a high-temperature environment of a temperature higher than 1250° C., operation of the high-temperature metal melting furnace to maintain a high-temperature environment of such a high temperature requires a high fuel cost and is economically disadvantageous, management of an operation to prevent impurities from mixing into the molten copper is technically difficult. Thus, the high-temperature environment of such a high temperature does not have a significant effect.

When the carbon content of the copper alloy is lower than 0.01% by weight, the electrical resistivity of the copper alloy is about the same as that of copper and the addition of carbon does not have any effect. When the carbon content of the copper alloy is higher than 0.6% by weight, the copper alloy has an electrical resistivity lower than the natural electrical resistivity of copper and a tensile strength excessively lower than that of copper. When the carbon content is higher than 0.6% by weight, it is very difficult to disperse carbon uniformly and it is difficult to guarantee practically acceptable quality. It was found through experiments that a preferable carbon content is in the range of 0.03% to 0.3% by weight. Since the atomic weight of carbon is smaller than that of copper, the number of added carbon atoms is not necessarily small even if the carbon content is in the range of 0.01% to 0.6% by weight.

Thus, the upper limit of the carbon content is 0.6% by weight. It is preferable that the carbon content is in the range of 0.03% to 0.3% by weight to ensure that the copper alloy has a low electrical resistivity and a high tensile strength.

The carbon content of the copper alloy is properly determined according to a tensile strength and a hardness and an electrical resistivity needed by the uses of the copper alloy.

Preferably, carbon to be added to copper is graphite of the hexagonal system. Since graphite is soft, graphite can be dispersed in practically acceptable uniformity in a high-temperature environment of a temperature in the range of 1200° C. to 1250° C. Carbon of the cubic diamond system is very hard. When carbon of the cubic diamond system is used, carbon cannot be dispersed in a practically acceptable uniformity even in the high-temperature environment of a temperature in the range of 1200° C. to 1250° C.

A carbon dispersant is added together with carbon to the copper to avoid the localized distribution of carbon and to promote the uniform dispersion of carbon in copper in the high-temperature environment.

A copper alloy manufacturing method according to the present invention will be described.

Figure 2:
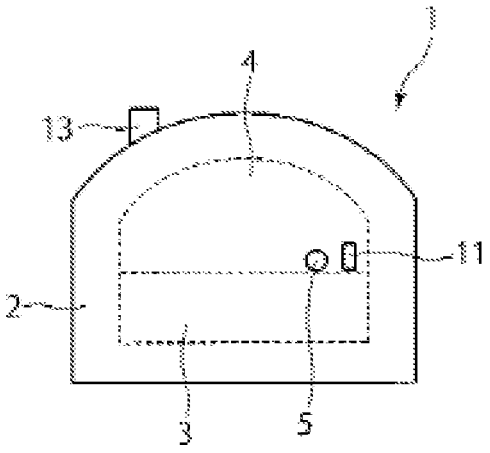
FIG. 2 is a sectional view of the high-temperature metal melting furnace.

FIGS. 1 and 2 are a plan view and a sectional view, respectively, of a high-temperature metal melting furnace 1. The high-temperature metal melting furnace 1 is a reverberatory furnace having a furnace wall 2 coated with a heat insulating wall and defining a charge container 3, i.e., a mold. A closed heating space 4 extends over the charge container 3. A top part of the furnace wall 2 demarcating an upper part of the closed heating space 4 has the shape of a dome. Radiant heat generated in the upper part of the closed heating space 4 is reflected so as to be concentrated on a copper material or such charged into the charge container 3. A firing opening 5 is formed in a front part of the furnace wall 2 of the high-temperature metal melting furnace 1. A burner 7 blows a mixture 9 of a high-temperature gas and air through the firing opening 5 into the closed heating space 4 to produce a flame that flows along a flame passage 9*a* to heat the copper material contained in the charge container 3 uniformly. The copper material is heated at temperatures in the range of 1200° C. to 1250° C.

The furnace wall 2 is provided with an exhaust opening 11 in a part near the firing opening 5. The condition of flames in the charge container 3 can be observed through the exhaust opening 11. For example, substantially complete removal of oxygen from the copper material charged into the charge container 3 can be empirically ascertained from the recognition of blue flames in the charge container 3 through the exhaust opening 11. A smokestack 13 is attached to a top part of the high-temperature metal melting furnace 1. It is also possible to ascertain the substantially complete removal of oxygen from the copper material contained in the charge container 3 through the observation of the condition, such as color, of smoke or flames discharged through the smokestack 13.

The copper alloy manufacturing method of the present invention includes: a melting process of melting the copper material by heating the high-temperature metal-melting furnace 1 charged with the copper material at a high temperature in the range of 1200° C. to 1250° C.; a carbon-adding process of adding a predetermined amount of granular or powdered carbon together with a carbon dispersant to the molten copper material melted by the melting process and held in the high-temperature environment; a stirring process of stirring a mixture of the copper material, the carbon and the carbon dispersant; and a cooling process of pouring the stirred mixture of the copper material and the carbon into a mold and cooling the mixture to solidify the mixture in the mold.

In the cooling process, the mixture of the copper material and the carbon stirred in the stirring process is poured through a tapping hole formed in the bottom of the high-temperature metal melting furnace 1 into a mold placed outside the high-temperature metal melting furnace 1 and is cooled in the mold.

The carbon dispersant is a powdered or granular additive. The carbon dispersant prevents the aggregation of carbon particles or grains and promotes the dispersion of carbon particles or grains in the copper material in the high-temperature environment. The carbon dispersant is added to the carbon. The weight ratio of the carbon dispersant to the carbon is in the range of 1 to 2.

When the mixture of the carbon dispersant and the powdered or granular carbon is added to the copper material melted in the melting process and held in the high-temperature environment, carbon particles adhere to small particles of the carbon dispersant and are held on the small particles of the carbon dispersant. While the small particles of the carbon dispersant holding the carbon particles are circulated vertically by convection in the molten copper material, the carbon particles can be dispersed in the molten copper material. Thus, the carbon particles separate from the carbon dispersant and only the carbon particles are mixed uniformly into the copper material. After the carbon particles held on the particles of the carbon dispersant have been separated from the particles of the carbon dispersant and mixed uniformly into the molten copper material, the carbon dispersant floats on the surface of the molten copper material. The carbon dispersant added together with the carbon to the molten copper material floats on the surface of the molten copper material in a short time of several minutes, for example, 2 min after the addition thereof to the molten copper material.

The carbon dispersant that has achieved uniformly dispersing the carbon in the molten copper material and floated on the surface of the molten copper material is collected with a heat-resistant ladle.

The carbon dispersant can be collected by the following method instead of a method using a ladle. The carbon dispersant floating on the surface of the molten copper material is poured together with the molten copper material through the tapping hole formed in the bottom of the high-temperature metal melting furnace into a mold and the carbon dispersant and the molten copper material is cooled in the mold. Then, the cooled carbon dispersant and the mixture of the copper material and the carbon are pounded with a hammer to separate the solidified carbon dispersant from the solidified mixture of the copper material and the carbon.

If the carbon dispersant is not used and the mixing of the molten copper material and the carbon is dependent only on stirring, the carbon particles will aggregate and will not be uniformly dispersed in the copper material. Therefore, it is preferable to use the carbon dispersant.

In the melting process, the closed heating space 4 is observed through the exhaust opening 11 to see whether or not flames in the charge container 3 or the closed heating space 4 is whitish blue and the rate of supplying fuel to the gas burner 7 is regulated so that oxygen discharged through the exhaust opening 11 is reduced to zero. Thus, the oxidation of the carbon added to the copper material contained in the charge container 3 and the resulting contamination of the copper material with carbon oxide can be prevented.

Results of measurement of the electrical resistivity and tensile strength of the copper alloy embodying the present invention manufactured by the copper alloy manufacturing method will be described.

FIG. 3 shows electrical resistivities of specimens (a), (b) and (c) measured by a four-probe method. The specimen (a) was pure copper, the specimen (b) was a copper alloy having a carbon content of 0.03% by weight, and the specimen (c) was a copper alloy having a carbon content of 0.3% by weight. The specimens (a), (b) and (c) have electrical resistivities of $1.97\times10^{-8}$ Ωm, $1.89\times10^{-8}$ Ωm and $1.71\times10^{-8}$ Ωm, respectively. The electrical resistivities of the specimens (b) and (c), namely, copper alloys containing carbon, are lower than that of the specimen (a), namely, pure copper. Thus, it was proved that the specimens (b) and (c) have satisfactory electrical resistivities.

It was confirmed that the electrical resistivity of the copper alloy was low, carbon was distributed uniformly in the copper alloy and the copper alloy had a practically acceptable quality when the copper alloy had a carbon content higher than 0.3% by weight and not higher than 0.6% by weight. Thus, it was proved through experiments that the copper alloy has a low electrical resistivity when the carbon content of the copper alloy was in the range of 0.01% to 0.6% by weight.

FIG. 4 shows results of tensile tests. A specimen (a) was pure copper, a specimen (b) was a copper alloy having a carbon content of 0.03% by weight, and a specimen (c) was a copper alloy having a carbon content of 0.3% by weight. Tensile tests used a tensile tester (AGS-500, Shimazu Seisaku-sho) for measurement. The specimens (a), (b) and (c) were flat plates of 26 mm in length, 3.0 mm in width and 0.23 mm in thickness. Stress (MPa) was applied lengthwise to the specimens and strain (%) was measured.

The relation between strain (%) developed in each of the specimens (a), (b) and (c) and stress (MPa) in the specimen was linear in an initial stress application stage, namely, an elastic deformation stage, in which stress was increased from zero. In a plastic deformation stage subsequent to the elastic deformation stage, the rate of increase of strain (%) relative to stress (MPa) decreased. A stress (MPa) at the transition from the elastic deformation stage to the plastic deformation stage is a yield stress (MPa). A peak stress (MPa) from which stress drops sharply is a tensile strength (MPa).

The respective yield stresses (MPa) and tensile strengths (MPa) of the specimen (a), namely, pure copper, the specimen (b), namely, the copper alloy having a carbon content of 0.03% by weight, and the specimen (c), namely, the copper alloy having a carbon content of 0.3% by weight indicated in FIG. 4 are tabulated in FIG. 5.

As shown in FIG. 5, the respective yield stresses (MPa) and tensile strengths (MPa) of the specimen (b), namely, the copper alloy having a carbon content of 0.03% by weight, and the specimen (c), namely, the copper alloy having a carbon content of 0.3% by weight are higher than those of the specimen (a), namely, pure copper. Those values showed that copper materials having properties better than those of pure copper can be obtained.

It was proved that the copper alloy having a carbon content of 0.03% by weight(the specimen (b)) and the copper alloy having a carbon content of 0.3% by weight (the specimen (c)) were stronger than pure copper and had satisfactory workability. Experiments showed that copper alloys having a carbon content in the range of 0.01% to 0.6% by weight were strong and had the above-mentioned satisfactory properties.

When the carbon content was higher than 0.6% by weight, copper alloys having electrical resistivity lower than that of pure copper (the specimen (a)) could not be steadily stably manufactured, which was considered to be due to difficulty in uniformly dispersing carbon in the copper material. There was no significant difference in tensile properties between copper alloys having a carbon content lower than 0.01% by weight and pure copper.

The invention claimed is:

1. A copper alloy manufacturing method comprising:

a melting process of melting a copper material and removing oxygen from the copper material by heating the copper material in a high-temperature metal-melting furnace at a temperature in the range of 1200° C. to 1250° C.;

a carbon adding process of adding a predetermined amount of carbon to the molten copper material melted by the melting process;

a stirring process of stirring a mixture of the copper material and the carbon; and a pouring process of pouring the stirred mixture of the copper material and the carbon into a mold and cooling the mixture to solidify the mixture in the mold to obtain a copper alloy, wherein the predetermined amount of carbon is determined such that the carbon content of the copper alloy is in the range of 0.01% to 0.6% by weight, wherein the carbon is hexagonal graphite, and wherein a carbon dispersant for promoting dispersion of the carbon in the copper in the high-temperature metal-melting furnace is added together with the carbon to the copper in the carbon adding process.

2. The copper alloy manufacturing method according to claim 1, wherein the carbon dispersant added to the molten copper contained in the high-temperature metal melting furnace floats on the surface of the molten copper material and the carbon dispersant floating on the surface of the molten copper material is collected.

3. The copper alloy manufacturing method according to claim 1, wherein the mixture of the copper material and the carbon stirred in the stirring process is poured through a tapping hole formed in the bottom of the high-temperature metal melting furnace into a mold placed outside the high-temperature metal melting furnace in the cooling process and the carbon dispersant is removed from the solidified mixture by pounding the solidified mixture.

4. The copper alloy manufacturing method according to claim 1, wherein the predetermined amount of carbon is determined such that the carbon content of the copper alloy is in the range of 0.03% to 0.3% by weight.

5. The copper alloy manufacturing method according to claim 1, wherein the high-temperature melting furnace has a melting unit to be charged with the copper material and the carbon, a heating space forming unit forming a closed heating space over the melting unit, a heating unit for supplying a heating fuel into the closed heating space to heat the melting unit, and an exhaust opening opening into the heating space.

6. The copper alloy manufacturing method according to claim 5, wherein the amount of the heating fuel to be supplied into the closed heating space is regulated such that the amount of oxygen discharged through the exhaust opening decreases to zero.

* * * * *